US007950545B1

(12) United States Patent
Roberts

(10) Patent No.: US 7,950,545 B1
(45) Date of Patent: May 31, 2011

(54) DRINKING VESSELS WITH SENSORY ENHANCERS

(76) Inventor: Darrol Roberts, Milton, MA (US)

( * ) Notice: Subject to any disclaimer, the term of this patent is extended or adjusted under 35 U.S.C. 154(b) by 279 days.

(21) Appl. No.: 11/741,052

(22) Filed: Apr. 27, 2007

Related U.S. Application Data

(60) Provisional application No. 60/795,441, filed on Apr. 27, 2006.

(51) Int. Cl.
*A47G 19/22* (2006.01)

(52) U.S. Cl. ..... 220/703; 220/669

(58) Field of Classification Search ..... 220/592.17, 220/669, 703; 366/130; D7/532
See application file for complete search history.

(56) References Cited

U.S. PATENT DOCUMENTS

| | | | | | |
|---|---|---|---|---|---|
| D48,081 | S | * | 11/1915 | Provance | D7/524 |
| D95,593 | S | | 5/1935 | Kramer | |
| D120,226 | S | * | 4/1940 | Lundy | D7/532 |
| D121,573 | S | | 7/1940 | Lundy | |
| D284,059 | S | * | 6/1986 | Durand | D7/527 |
| D299,993 | S | * | 2/1989 | Durand | D7/527 |
| D333,591 | S | * | 3/1993 | Gradecki et al. | D7/514 |
| D359,197 | S | | 6/1995 | Hernandez et al. | |
| 6,065,603 | A | * | 5/2000 | Filice et al. | 206/519 |
| 6,409,374 | B1 | * | 6/2002 | Willat | 366/130 |
| 6,644,846 | B2 | * | 11/2003 | Willat | 366/130 |
| 2003/0159245 | A1 | * | 8/2003 | Harman | 16/110.1 |

OTHER PUBLICATIONS

"How Tongues Taste The Carbonation in a Fizzy Beverage", New York Times, Jan. 20, 2009, 1 page.
http://www.jbpierce.org/Labs/AffectiveSensoryNeuro.html.
http://www.nathan.com/projects/current/senses.html.
http://www.riedel.com/website/english/frameset/frameset.html.
http://www.sff.net/people/mberry/taste.htmhttp://www.sff.net/people/mberry/taste.htm.
http://www.ncbi.nlm.nih.gov/entrez/query.fcgi?cmd=Search&db=PubMed&term=smell+and+saliva+flow&tool=QuerySuggestion.
http://www.findarticles.com/p/articles/mi_mOBQE/is_3_16/ai_n13672763.
http://www.diwinetaste.com/dwt/en2003036.php.
Lawless, Harry T., "Sensory evaluation of food: principles and practices" Springer; 2nd Edition. edition (Sep. 14, 2010), Sections 2.5-2.6, pp. 41-50.
Kessler, David, "The End of Overeating: Taking Control of the Insatiable American Appetite", Rodale Books, Apr. 28, 2009, Chapter 7, pp. 35-40.

* cited by examiner

*Primary Examiner* — Anthony Stashick
*Assistant Examiner* — Harry A Grosso
(74) *Attorney, Agent, or Firm* — Cesari and McKenna, LLP

(57) ABSTRACT

A drinking vessel having one or more sensory enhancing features disposed within a circumferential region in close proximity of the rim of the drinking vessel, such as a wine glass, is provided. The sensory enhancing features are located on the vessel near the rim at such a location that, when a user places the vessel or glass to his or her mouth, the sensory enhancing features of the present invention first contact the sensitive nerve endings on the user's tongue. The designs are etched into or raised from the surface of the vessel and placed where the touch sensitive nerve endings on the tongue can be stimulated. Thus, the sensitive nerve endings on the tongue are stimulated such that a sense of touch is enhanced, and further the flow of saliva is also stimulated to enhance the sense of taste.

7 Claims, 5 Drawing Sheets

DRINKING VESSELS WITH SENSORY ENHANCERS

CROSS-REFERENCE TO RELATED APPLICATIONS

The present application claims the benefit of U.S. Provisional Patent Application Ser. No. 60/795,441, which was filed on Apr. 27, 2006, by Roberts for IMPROVED DRINKING GLASSES, and is hereby incorporated by reference.

BACKGROUND OF THE INVENTION

1. Field of the Invention

This invention relates to drinking vessels in general, and more particularly, to drinking vessels, such as wine glasses that include sensory enhancing features that enhance a user's taste sensation and taste perception.

2. Background Information

An individual's perception of taste is a combination of physiological and psychological responses to food and drink stimuli.

Flavor is the sensation realized when a food or beverage is placed in the mouth. The overall sensation of flavor is the result of a combination of responses to receptors present on the tongue, in the mouth, throat and nose. These sensory receptors produce signals in the nervous system and enable us to differentiate between products and environments in sensory terms.

When food or beverages enter the mouth, they contact gustatory receptors on the tongue and palate. The sensations produced are sweet, salty, sour, or bitter. At the same time, volatiles from the foods and beverages rise through the oral and nasal cavities and ultimately reach the olfactory receptors located just under the eyes. That is, while we eat, we both taste and smell foods. We call the composite sensation "flavor", which we perceptually attribute to occur in the location of the mouth.

It is believed that this 'localization' is produced by the sense of touch. Taste sensations are not localized to the location of taste buds, but rather to areas touched in the mouth. Thus during drinking and eating, taste sensations seem to originate from the entire mouth, even though the taste buds are found only on certain loci. This occurs because the brain uses the sense of touch to localize taste sensations. Touch is critical to the taste process and the tongue is at the center of the 'touch-taste' equation.

Lawless and Stevens (1988) showed there are differential responsiveness to stimuli within the mouth, with the tongue tip being most sensitive, followed by the lip-tongue side, the posterior palate, the posterior tongue, the anterior palate, and then the is cheek.

The tongue is a mass of "voluntary" muscles called intrinsic and extrinsic muscles. The intrinsic muscles allow the tongue to change size and shape quickly. The flexible extrinsic muscles allow the tongue to rapidly change position. The bottom of the tongue is attached to the floor of the mouth, where some of the salivary glands are located.

The tongue is covered with a mucous membrane formed into nipple like elevations called papillae. Papillae roughen the tongue's surface to help it guide foods during chewing and swallowing. Papillae also contain nerves for touch sensations, and most contain taste buds. Examination of the tongue with a mirror reveals a row of v-shaped, rounded, raised areas toward the back of the tongue where the taste buds responding to bitterness are located. In front of this row are tall, thin, cone-shaped raised areas that respond to sweet, sour, or salty substances. At the sides of the tongue are taste buds that react to acidic ingredients.

The tongue has several functions. It is involved in speech, manipulation and positioning of food, tasting, and swallowing. The tongue aids chewing by crushing food against the roof of the mouth (the palate) and by rolling the food between the teeth. Swallowing is accomplished as the tongue presses the food against the palate and pushes it backward into the oropharynx, the entrance into the digestive and respiratory systems.

The smell and touch of food stimulate the salivary glands to secrete saliva. Saliva contains water, salts, enzymes, and mucus-moistens and softens foods for ease in swallowing, and cleanses the teeth and mouth.

Saliva is a critical component of taste function. When we taste, we taste in a solution with saliva acting as a solvent. Chewing and the movement of the tongue, stimulates secretion of saliva, as do the stimuli of thought, sight and smell. Further, a combination of these factors may lead to anticipation of the taste sensation before the product is placed in the mouth. Hence, the well-known expression: 'It makes my mouth water'.

There are a few minor salivary glands situated around the lips, inside the cheeks, in the palate, and on the tongue. There are also three major pairs of salivary glands. On each side of the face, just in front of the ears, are the parotid glands, the largest of the salivary glands. The duct for each parotid gland, called Stenson's duct, opens into the mouth from each cheek opposite the upper second molar. The parotid glands produce a clear watery secretion that functions as a cleansing, dissolving, and digestive agent. The saliva produced by the parotid gland contains a substance called ptylin, a salivary enzyme that breaks down starch. When a sour food such as a lemon is introduced into the mouth, it stimulates the parotid glands.

The sublingual glands are located in the floor of the mouth, under the tongue. The duct for these glands, called Rivinus' duct, opens into the mouth from the floor of the mouth directly behind the lower front teeth. The saliva secreted by this gland is thicker and ropey compared with the secretion from the parotid. Sublingual-gland secretions serve as lubricating agents; bland substances such as milk and bread stimulate its production.

The submandibular glands are located deeper in the floor of the mouth, under the base of the tongue and more to the side of the lower jaw. These glands secrete a mixed type of saliva that is thin at first and becomes thicker. This secretion is also used for lubricative and digestive purposes.

Hormones produced by the pancreas, testes, ovaries, thyroid and pituitary glands affect the function of the salivary glands. Their nature and quantity of saliva, is a reflex reaction. The presence of soft moist foods on the tongue will stimulate less salivary secretion than does presence of harder textures.

The combination of the senses of taste and smell together with tactile sensations of the sense of touch, provide the flavor of a product. When a food or drink product is placed in the mouth the primary tastes are recognized on the tongue, along with the textural and other associated sensations within the mouth and on the palate. Identity is conferred as a result of the volatile components moving from the back of the mouth into the is olfactory area where the smell mechanism operates.

Up to the present time, though may have been suggested that the shape of a drinking vessel may affect the drinking enjoyment experience, and it has been suggested to form the glass to allow for the sense of smell to be first affected, it has not been known to enhance the taste by stimulating the touch sensations in the user's tongue to thereby prestimulate the senses of taste and touch. The remains a need therefore, for a drinking vessel that is formed in such a manner that the sensory experience is further enhanced.

SUMMARY OF THE INVENTION

These and other needs are satisfied by the improved drinking vessel and related method of the present invention. More specifically, in accordance with the invention, one or more sensory enhancing features are provided within a circumferential region on a drinking vessel, such as a wine glass. These sensory enhancing features are located on the exterior surface of the glass near the rim at such a location that, when a user placed the glass to his or her mouth, the sensory enhancing features of the present invention first contact the sensitive nerve endings on the user's tongue in an anatomically distinct anterior two third of the tongue which is generally accepted as the most sensitive area of tongue. The sensory enhancing features are formed in the region in close proximity to the rim of a drinking vessel. The designs are etched into or raised from the exterior surface of the vessel and placed where the touch sensitive nerve endings on the tongue can be stimulated. When the tongue makes contact with the hard, uneven texture of the raised designs, the genital corpuscle nerve endings at the tip of the tongue are stimulated. Thus, the sensitive nerve endings on the tongue are stimulated such that a sense of touch is enhancing, and further the flow of saliva is also stimulated to enhance the sense of taste. Thus, these two senses are prestimulated when the lips and/or tongue are touched thereby to enhance taste sensation and sensory experience generally, particularly with respect to drinking and enjoying wines. This enables a widening of the spectrum of the taste experience for the user of the glass, or other drinking vessel. The sensory enhancing features can also add to the appearance of the drinking vessel as they can be of any number of shapes and designs.

BRIEF DESCRIPTION OF THE DRAWINGS

The invention description below refers to the accompanying drawings, of which.

DETAILED DESCRIPTION OF AN ILLUSTRATIVE EMBODIMENT

The present invention is an improved drinking vessel and related method of manufacturing a drinking vessel, which vessel is designed to stimulate the body's pleasure centers associated with the perception of flavors in drinks. The perception of flavors in food and drinks is a composite sensation comprised of taste and smell. Whereas prior technical manufacturing and design improvements for drinking vessels have been focused on enhancing smell, notably wine glasses sold by the Riedel Crystal Company's in shapes specifically designed to enhance the aromas present in specific varieties of wine.

The present invention however, is focused on enhancing the taste and touch components of flavor perception, through touch stimulation of the tongue. The word 'taste' is derived historically first from the Latin Taxare, meaning to touch sharply and from the old English word Tasten, which means to examine by touch. Touch is the first and oldest sense. It is the most urgent and the most intimate. Touch, in its many manifestations, is the source of immense sensual pleasures in humankind. Touch sensations are recorded and interpreted in the oldest evolutionary segment of the human brain—the Limbic System.

The Limbic System commands certain behaviors that are necessary for the survival of all mammals. It gives rise and modulates specific functions that allow the animal to distinguish between the agreeable and the disagreeable. It is called a "system" because it is actually made up of a number of different centers controlling pleasure, rage, fear, and other emotional reactions. Gentle touch stimulates the pleasure centers in normal individuals.

Touch is critical to allowing the body to record the taste process. Touch is required in order for the body to register and discern flavors that are present in foods and drinks. In accordance with the present invention, the novel drinking vessels, such as wine glasses provide touch stimulation of the tongue to amplify the taste experience and expand the experience beyond the limits of smell stimulation.

I. The Body—Stimulation and Reaction

By way of further background, much of our primary pleasurable stimulus comes from the skin. As such, defining, the sensory receptors of the skin are important in understanding the complexities of touch stimuli.

There are two types of erogenous zones that exist in the skin: Nonspecific and Specific. In the 'Nonspecific' type, the skin is similar to any other portion of the usual haired skin. That is, the nerves supplying it are composed of the usual density of dermal-nerve networks, (free nerve endings) and hair-follicle networks. Examples of this type of skin are the sides and back of the neck, the axillas and the sides of the thorax. The pleasurable sensation perceived from these regions is simply an exaggerated form of tickle. The pleasant associations and the learned and anticipated responses concurrent with the stimulus produce the final amplified central sensation.

Figure 1:
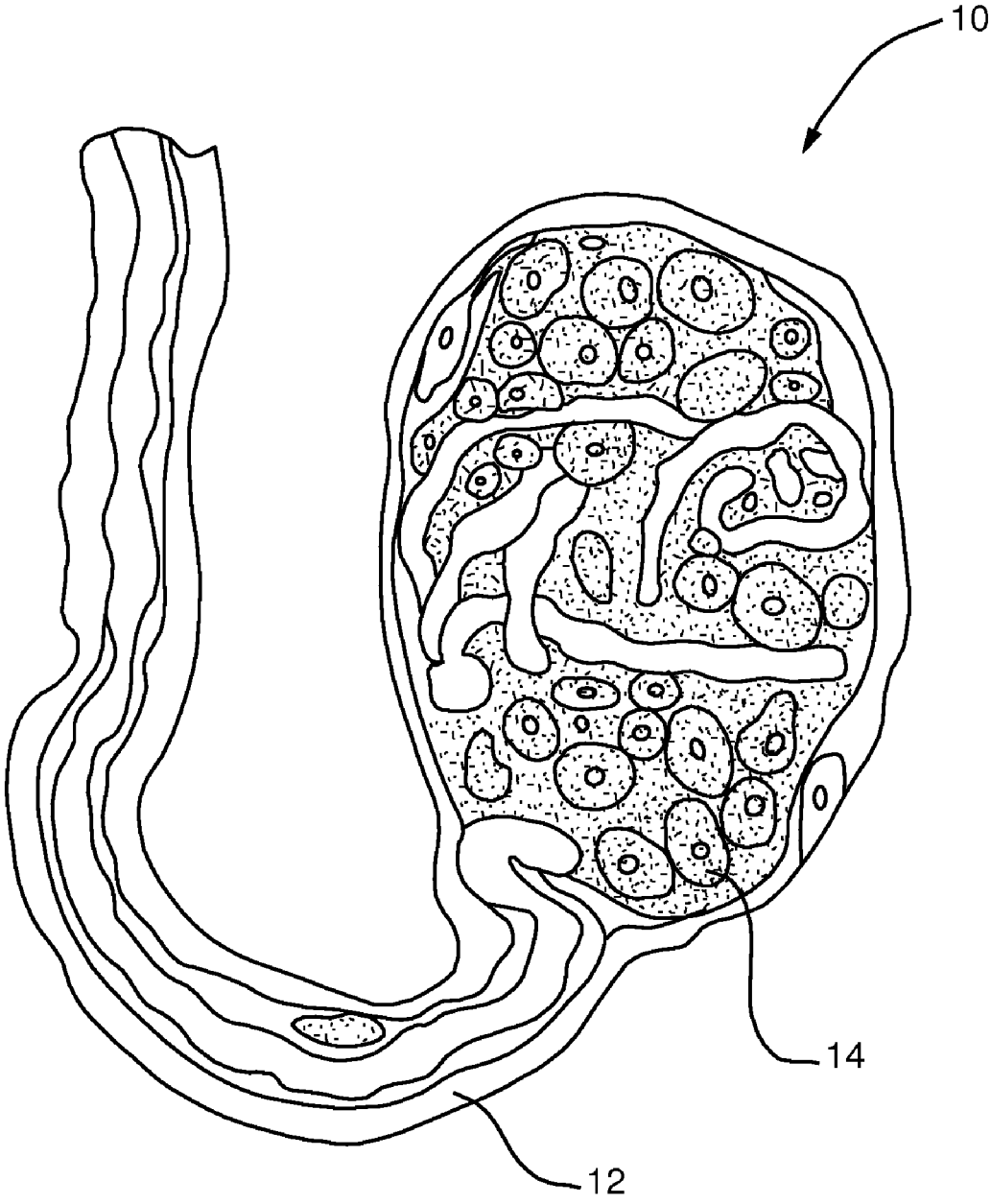
FIG. 1 is a schematic illustration of a sensory corpuscle such as would be found on the tongue.

The 'Specific' type of erogenous zone found is found in the mucocutaneous regions of the body. Such specific sites of acute sensation in the body are found in the genital and oral regions, including the lips and tongue. It is the special anatomy of these regions that require the use of the term "specific", when one speaks of pleasurable sensations originating in the skin. This anatomy favors acute perception. The rete ridges of the epithelium are well formed and more of the organized nerve tissue rises higher in the dermis than is true of haired skin. The tongue is one of the body's 'specific' erogenous zones. That is, the rete ridges of the epithelium are well formed and the nerve tissue rises higher, are well formed and more organized when compared to haired skin. Specifically, the nerves do not end by disappearing into the skin as does the 'free nerve endings' found in the non-specific zones. Instead, they appear as an oval or cylindrical formation. As shown in FIG. 1, a capsule 10 is formed by the expansion of the connective-tissue sheath of a medullated fiber 12, and contains a soft semifluid core 14 in which the axis-cylinder terminates either in a bulbous extremity or in a coiled-up plexiform mass.

Again, these end-bulbs are found in the mucous membrane of the lips and tongue, and in the epineurium of nerve trunks. As stated earlier, the tongue is covered with a variety of papillae that give it its bumpy appearance. These are called the filiform, fungiform, foliate and circumvallate papillae. Filiform papillae are the most numerous but they contain no taste buds. The fungiform papillae are distributed most densely at the tip (the front of the tongue contributes a disproportionate amount to whole taste-nerve responses) and on the edges of the tongue. The foliate papillae consist of a series of folds on the rear edges of the tongue. Foliate papillae can be seen at the base of the tongue. The circumvallate papillae are large circular structures on the rear of the tongue.

A common characteristic of 'specific zones' is that they can be stimulated. Stimulation of these zones prepares the body to be more receptive to the associated activities and sensations. Stimulation results in increased blood flow to specific organs and areas of the body as well as the production of various mucous secretions. For purposes of the present disclosure, stimulation of the tongue prepares the body for the pleasures associated with taste. Stimulating the tongue's nerve endings at the tip of the tongue, (fungiform papillae) in turn stimulates saliva flow. Saliva flow in conjunction with aroma and scent, in turn stimulates the taste buds, essentially preparing them to register taste. Increased saliva flow heightens the body's preparedness to taste. It is noted that the converse is also true, that damaged or poorly performing salivary glands result in diminished taste spectrum and functionality. Notably, stimulated taste sensors result in an improved and expanded taste spectrum for food and drink. Thus, when stimulated, the heightened taste sensors make the taste experience more complete.

II. Drinking Vessels

Figure 2:
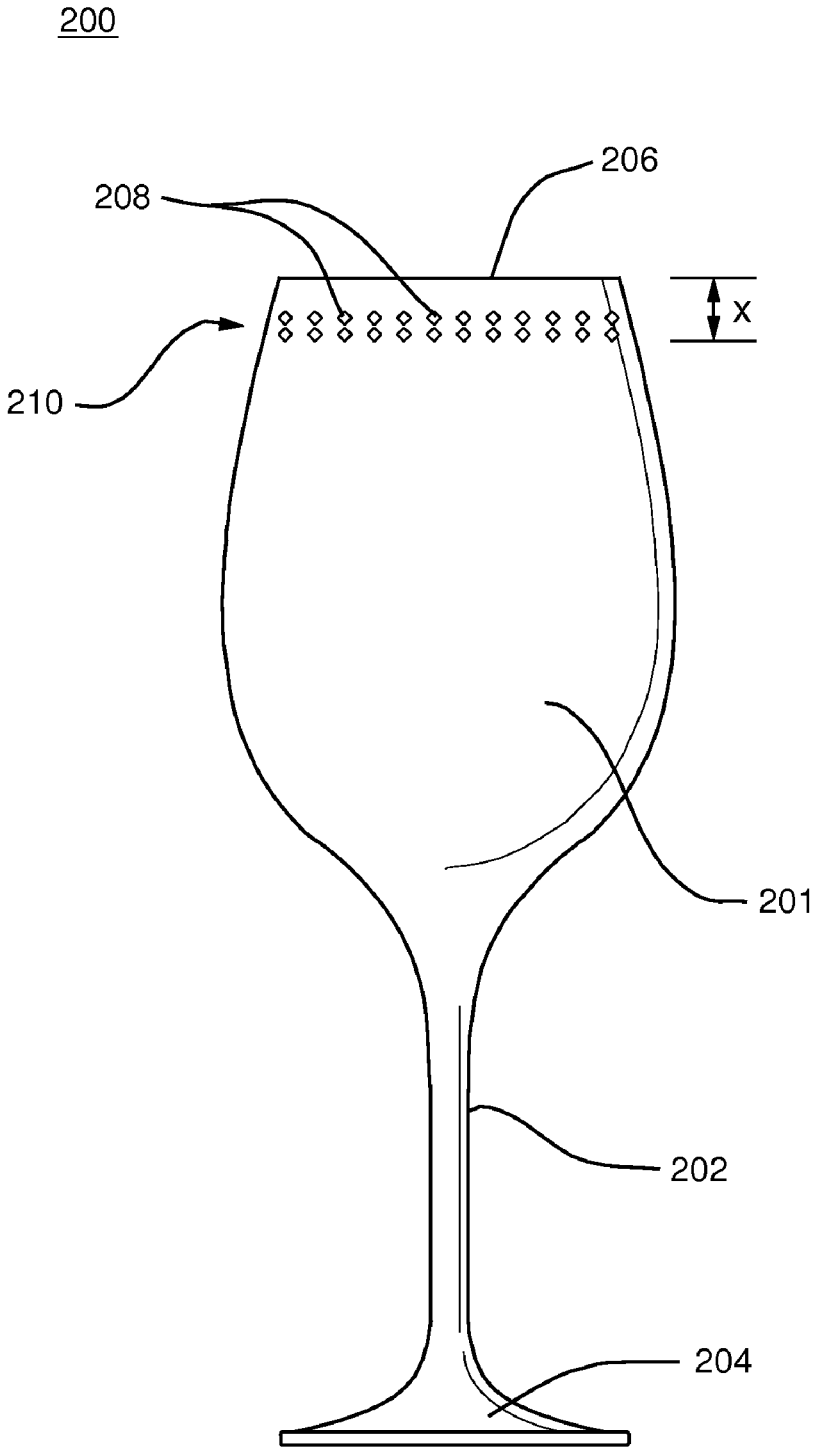
FIG. 2 is a schematic illustration of an illustrative embodiment of the present invention depicting the sensory enhancing features of the present invention on a wine glass.

FIG. 2 illustrates a wine glass 200 having a bowl 201 that holds the liquid, and the bowl 201 has a rim 206. The bowl 201 is attached to a stem 202 that rests on a base 204. The glass 200 is typically formed of clear glass crystal or other suitable materials. An upper portion of the bowl 201, which is within at least about 1 centimeter of the circumference of the rim 206 and is preferably between about 1 to 5 millimeters of the rim 206 is designated as region 210, as by the dimension x.

In accordance with the invention, one or more sensory enhancing features 208 are provided within the region 210 on the glass 200. These sensory enhancing features 208 are located on the exterior surface of the glass near the rim at such a location that, when a user places the glass to his or her mouth, the sensory enhancing features 208 of the present invention first contact the taste sensitive nerve endings on the user's tongue in an anatomically distinct anterior two third of the tongue which is generally accepted as the most sensitive area of the tongue. Thus, the taste sensitive nerve endings on the tongue are stimulated and saliva is also produced. This enables a widening of the spectrum of the taste experience for the user of the glass 200.

Figure 3:
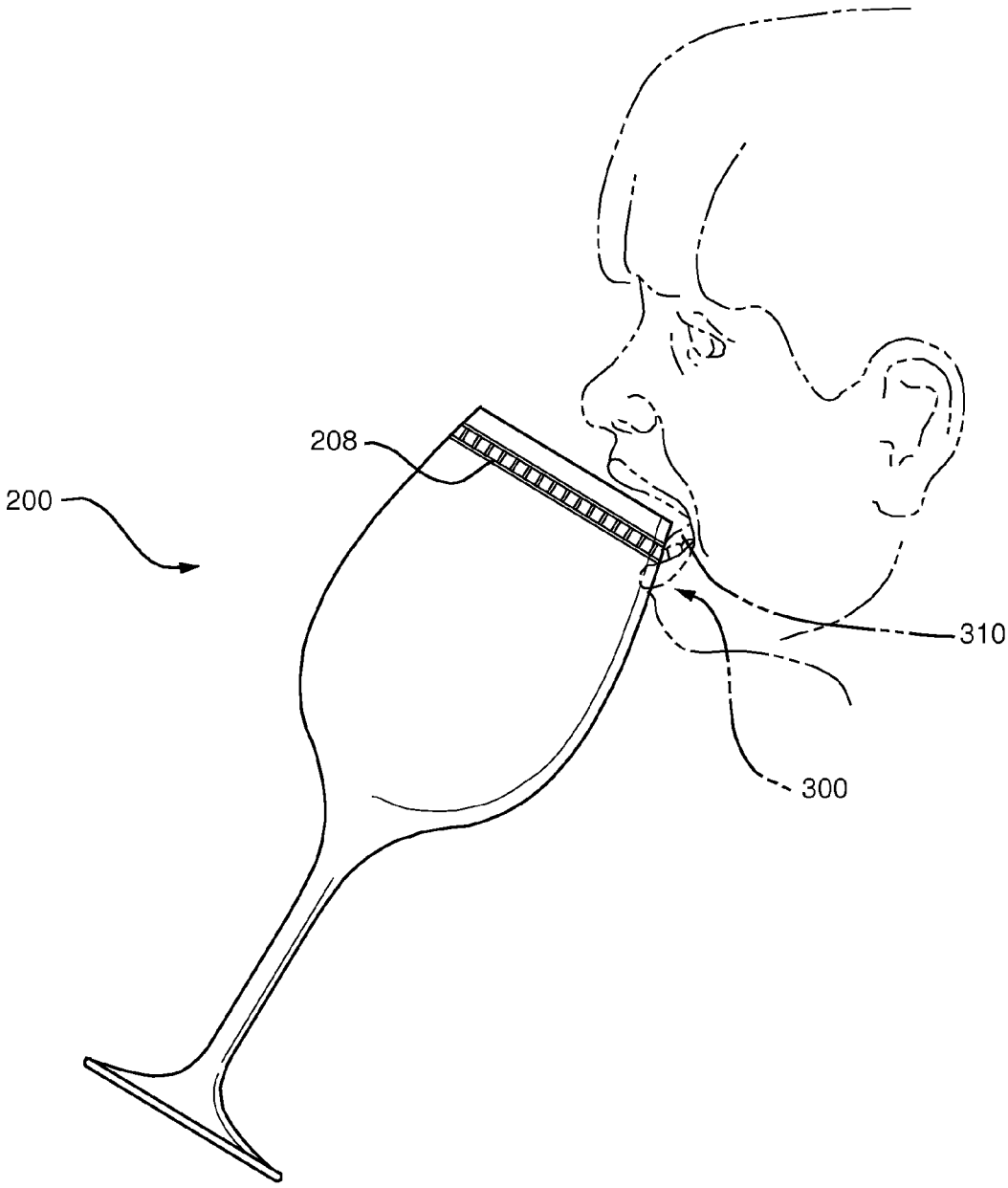
FIG. 3 is a schematic illustration of a person using an illustrative embodiment of a drinking vessel in accordance with the present invention.

FIG. 3 illustrates a user's mouth 300 with a wine glass 200 of the present invention. The user brings the glass 200 to his or her mouth 300 and begins to drink in the usual motion. However, the glass of the present invention includes the taste enhancers 208 which come in contact with the taste sensitive nerve endings on the user's tongue 310. Thus, the user's tongue is stimulated which, in turn, starts the flow of saliva, thereby enhancing the wine drinking experience in accordance with the invention.

In accordance with the method of the present invention, the sensory enhancing features 208 may be integrated into the region 210 of the glass 200 using a number of suitable techniques. One presently illustrative technique is by laser-etching the sensory enhancing features 208 into the glass during the manufacturing process. This laser etching includes forming one or more rings around the glass in the region 210. Alternatively, the sensory enhancing features formed by etching may take the form of individual designs as described herein after. The sensory enhancing features may take the form of dimples, ridges, geometric shapes and other patterns etched into the glass.

In an alternative embodiment of the method of the present invention, in addition to laser etching, the sensory enhancing features 208 may be molded into the drinking vessel body material during manufacture in a ceramic vessel, for example.

Figure 4:
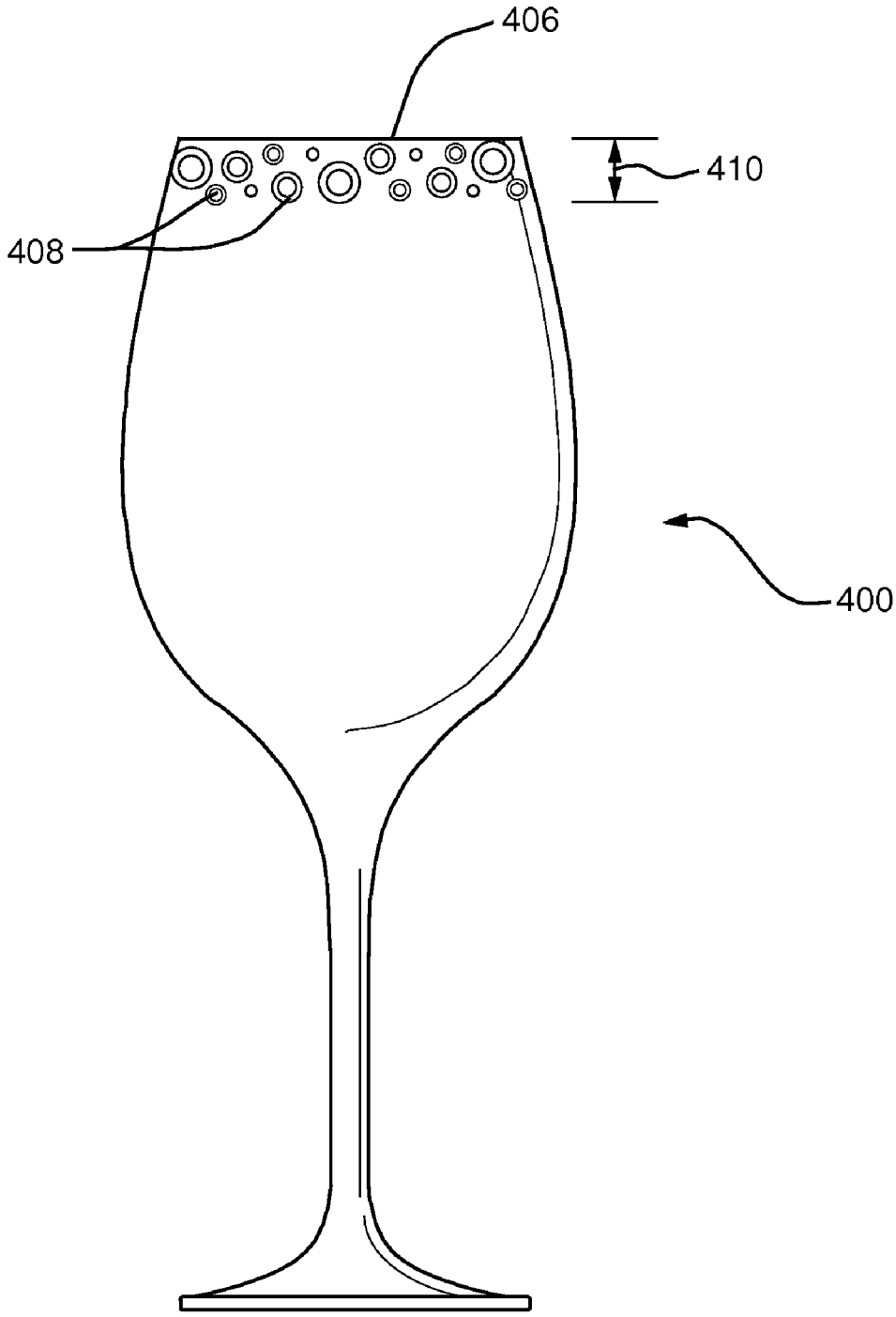
FIG. 4 is a schematic illustration of another illustrative embodiment of the present invention depicting sensory enhancing features of the present invention on a wine glass.

As noted, the invention is readily adaptable for use with a variety of types of sensory enhancing features for a variety of drinking vessels. FIG. 4 illustrates, for example, a another wine glass 400 having the sensory enhancing features 408 which are of a circular form that may be either dimpled into the glass, etched into the glass or raised from it. The features 408 are disposed in the region 410.

In accordance with another aspect of the invention, the sensory enhancing features 408 may take the form desired in the particular application of the invention and may be designs and such as are appropriate for a wedding, anniversary, graduation or other occasion and may include names, dates and congratulatory wording and the like. In accordance with the invention, the sensory enhancing features 408 are disposed in close proximity of the rim 406 such that the region 410 is within about 1 centimeter of the rim 406, circumferentially. Preferably, in the embodiment of FIG. 4, the sensory enhancing features 408 are disposed between about 1 millimeter and 5 millimeters below said rim 406 of the glass in the region 410.

Figure 5:
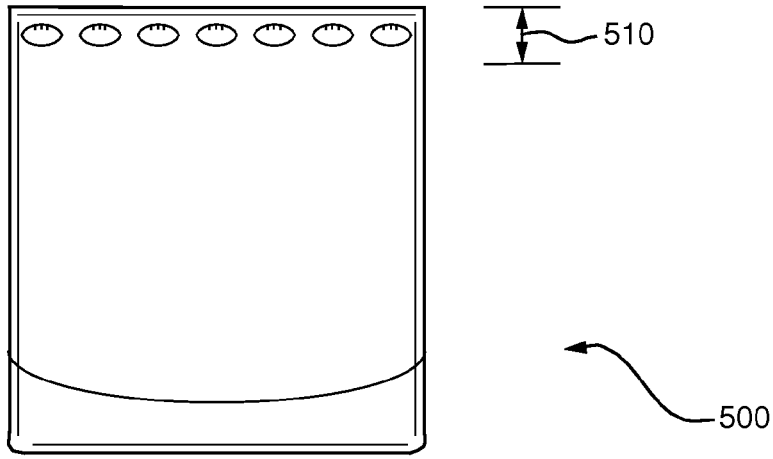
FIG. 5 is a schematic illustration of an illustrative embodiment of the present invention depicting the sensory enhancing features of the present invention on a tumbler.

FIG. 5 illustrates a tumbler 500 having a region 510. The tumbler 500 may be a glass for a mixed drink, or alternatively may be formed of a non-breakable material such as plastic and may hold a child's beverage. The tumbler 500 may include sensory enhancing features 508 such a sports designs including footballs, baseballs, basketballs and soccer balls, or may take the form of characters, animals and toys.

Figure 6:
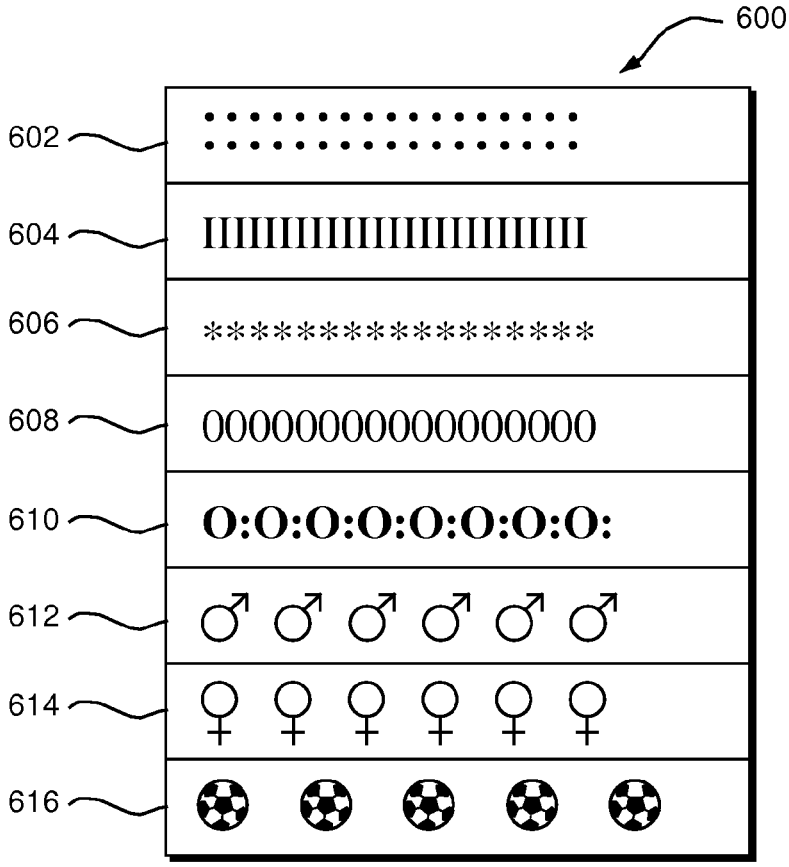
FIG. 6 is a chart of a number of illustrative embodiments of sensory enhancing features in accordance with the present invention.

FIG. 6 is a chart 600 of exemplary sensory enhancing features that may be etched or formed in the rim of a drinking vessel in accordance with the invention. Sensory enhancing features 602 are patterned dots, Roman numeral designs 604, stars 606, zeroes 608, circle and dot design 610, male and female symbols 612, 614 and soccer balls 616.

The sensory enhancing features are molded in close proximity to the rim of a drinking vessel within about 1 centimeter of the rim and preferably between about 1 millimeter and 5 millimeters below said rim. It has hereto for not been known to provide sensory enhancing features in such close proximity to the rim of a vessel as it was thought to interfere with the tasting process.

It should be understood that the present invention provides an improved drinking vessel, such as a wine glass that includes sensory enhancing features near the rim of the glass which improves the user's enjoyment of the beverage. The sensory enhancing features may advantageously be etched into the vessel, such as in glass, during manufacturing or otherwise molded into the drinking vessel.

It should be understood that the sensory enhancing features of the present invention can be implemented using any type of drinking vessel, including but not limited to water glasses, beer glasses, high ball glasses, low ball glasses, coffee and tea mugs, disposable "take out" cups, and/or the associated disposable lids, baby "sippy" cups and baby bottle nipples. The sensory enhancing features are functional designs that take advantage of the importance of the tongue and its role in the taste process.

In summary, in accordance with the invention, a number of sensory enhancing features are formed in the region in close proximity to the rim of the drinking vessel. The designs are etched into or raised from the exterior surface of the vessel and placed where the touch sensitive nerve endings on the tongue can be stimulated. When the tongue makes contact with the hard, uneven texture of the raised designs, the genital corpuscle nerve endings at the tip of the tongue are stimulated. They in turn drive increased saliva flow and enable the widening spectrum of taste sensation possibilities for the taster. The designs and patterns are molded at the top of the drink ware, typically within 1 centimeter from the rim although applications may exceed the 1-centimeter threshold. Some design applications may also utilize the rim of the drinking vessel as well.

The foregoing description has been directed to particular embodiments of the invention. It will be apparent, however, that other variations and modifications may be made to the described embodiments with the attainment of some or all of their advantages. Therefore, it is the object of the appended claims to cover all such variations and modifications as come within the true spirit and scope of the invention.

What is claimed is:

1. A drinking vessel comprising:

a glass or ceramic bowl portion for holding a beverage, said bowl portion including an interior surface, an exterior surface and a rim that has a smaller diameter than the bowl portion immediately below the rim, said rim joining said surfaces from which a user may drink a beverage, and a plurality of separate taste enhancers formed in said exterior surface in an exterior circumference of the bowl portion that is located within about 1 centimeter from said rim, said taste enhancers each having a hard, uneven texture over their entire surface, and being evenly spaced apart around the entire circumference of said bowl portion and which, when a user drinks from the bowl, contact and stimulate nerve endings at the user's lips and the end of the user's tongue so as to encourage saliva flow in the user's mouth which enhances the user's taste sensation, said bowl portion being devoid of taste enhancers below the circumference of the bowl portion that contains the taste enhancers, and the interior surface of the bowl beneath the taste enhancers being smooth.

2. The drinking vessel as defined in claim 1 wherein said circumferential region is between about 1 millimeter and 5 millimeters below said rim.

3. The drinking vessel as defined in claim 1 wherein said taste enhancers comprise one or more of the following: dimples, ridges, geometric shapes and patterns.

4. The drinking vessel as defined in claim 3 wherein said taste enhancers are laser-etched into said drinking vessel.

5. The drinking vessel as defined in claim 3 wherein said taste enhancers are molded into said drinking vessel.

6. The drinking vessel as defined in claim 1 wherein said drinking vessel is one of the following: a white wine glass, a red wine glass, a champagne flute and a glass tumbler.

7. An improved beverage glass, comprising:

a glass bowl portion for holding a beverage, said bowl portion including an interior surface and an exterior surface and a rim having a smaller diameter than the bowl portion immediately beneath said rim, said rim joining said surfaces allowing a user to drink a beverage from said bowl portion, said bowl portion being supported by a stem and a base; and a plurality of separate taste enhancers each having a hard uneven texture over their entire surface, and being formed in said exterior surface around a circumference of the bowl portion, and said features being evenly spaced apart from one another around an entire circumference of said bowl portion, and said taste enhancers being disposed from at least one 1 millimeter below the rim to within 1 centimeter below the rim, said taste enhancers being located on said bowl portion such that one or more taste enhancers meet a user's tongue and lips when the user drinks from said bowl portion, and the interior surface of the bowl portion that is beneath said taste enhancers being smooth.

* * * * *

UNITED STATES PATENT AND TRADEMARK OFFICE

CERTIFICATE OF CORRECTION

PATENT NO. : 7,950,545 B1
APPLICATION NO. : 11/741052
DATED : May 31, 2011
INVENTOR(S) : Darrol G. Roberts It is certified that error appears in the above-identified patent and that said Letters Patent is hereby corrected as shown below:

Col. 1, line 53: should read -- "then the ~~is~~ cheek."

Col. 2, line 61: should read -- "the ~~is~~ olfactory area where the smell mechanism operates."

Col. 3, line 14: should read -- "place~~d~~s the glass to his or her mouth, the sensory enhancing"

Col. 3, line 17: should read -- "anterior two third<u>s</u> of the tongue. The sensory enhancing"

Col. 5, line 51: should read -- "user's tongue in an anatomically distinct anterior two third<u>s</u> of"

Col. 8, line 29: should read -- "uneven texture over the~~ir~~ entire surface, and being"

Signed and Sealed this
Nineteenth Day of July, 2011

David J. Kappos

David J. Kappos
*Director of the United States Patent and Trademark Office*